US008093574B2

(12) United States Patent
Stichelbaut et al.

(10) Patent No.: US 8,093,574 B2
(45) Date of Patent: Jan. 10, 2012

(54) SHIELDING FOR IONIZING RADIATION

(75) Inventors: Frederic Stichelbaut, Mazy (BE); Albert Blondin, Incourt (BE); Jean-Claude Amelia, Erquelinnes (BE)

(73) Assignee: Ion Beam Applications S.A., Louvain-la-Neuve (BE)

( * ) Notice: Subject to any disclaimer, the term of this patent is extended or adjusted under 35 U.S.C. 154(b) by 429 days.

(21) Appl. No.: 12/303,062

(22) PCT Filed: Jun. 1, 2007

(86) PCT No.: PCT/EP2007/055427

§ 371 (c)(1),
(2), (4) Date: Dec. 1, 2008

(87) PCT Pub. No.: WO2007/141223

PCT Pub. Date: Dec. 13, 2007

(65) Prior Publication Data

US 2009/0194713 A1 Aug. 6, 2009

Related U.S. Application Data

(60) Provisional application No. 60/810,484, filed on Jun. 2, 2006.

(30) Foreign Application Priority Data

Dec. 8, 2006 (EP) ..... 06125737

(51) Int. Cl.
*G21F 3/04* (2006.01)

(52) U.S. Cl. ..... 250/515.1; 250/517.1

(58) Field of Classification Search ..... 250/515.1, 250/517.1
See application file for complete search history.

(56) References Cited

U.S. PATENT DOCUMENTS

| | | | | |
|---|---|---|---|---|
| 5,039,826 | A * | 8/1991 | Newland | 174/374 |
| 5,063,299 | A * | 11/1991 | Efferding | 250/507.1 |
| 5,174,945 | A | 12/1992 | Bussard et al. | |
| 2005/0218347 | A1 | 10/2005 | Williamson et al. | |

FOREIGN PATENT DOCUMENTS

| | | | |
|---|---|---|---|
| GB | 2 358 415 | A | 7/2001 |
| WO | 00/19450 | A | 4/2000 |

OTHER PUBLICATIONS

International Search Report, International Patent Application No. PCT/EP2007/055427, date of the actual completion of the international search Sep. 14, 2007, 2 pages.

International Preliminary Report on Patentability and Written Opinion of the International Searching Authority, International Patent Application PCT/EP2007/055427, date of issuance of this report Dec. 3, 2008, 6 pages.

* cited by examiner

*Primary Examiner* — Kiet Nguyen
(74) *Attorney, Agent, or Firm* — Fitch, Even, Tabin & Flannery

(57) ABSTRACT

A shielding (11) for reducing the amount of radiation passing through the shielding comprises a first part (111) and a second part (112), wherein the first part is arranged for being withdrawn from the second part and wherein said first and second parts comprise abutments. At least one pair of corresponding abutments of said first and second parts has a transverse section which is curvilinearly shaped along a portion of at least half of said transverse section.

17 Claims, 18 Drawing Sheets

SHIELDING FOR IONIZING RADIATION

FIELD OF THE INVENTION

The present invention is related to a shielding for ionizing radiation. More particularly, the present invention is related to a shielding with at least one movable part, said part arranged for opening said shielding.

STATE OF THE ART

Radiation emitting sources, such as particle accelerators, targets, radioactive sources or wastes, emit unwanted ionising radiations, such as protons, neutrons, electrons and photons. In order to protect personnel from irradiation diseases, these radiation sources are generally placed in a shielding. The shielding must absorb the majority of the emitted radiations, such that transmission through the shield is below a threshold level specified by law or by company specifications.

A basic solution for shielding is achieved by encapsulating said radiation sources, e.g. a cyclotron, into walls of concrete and/or other compounds. Such a configuration is known from document GB 2358415. The document discloses the use of building blocks to construct shielding walls. These blocks are provided with male and female-type sides that snugly fit into each other. The male-type sides have a tongue, bordered by coplanar shoulders. The shoulders occupy at least 20% of the total width of the blocks. However, this solution has a drawback as follows: when the installation of such walls around a radiation source is completed, the radiation source is no more accessible, unless one or more blocks are removed from the walls. This operation can be relatively long and complex due to blocks weight or numbers.

Another solution is described in document US 2005/0218347, wherein one or more doors are provided for selectively access a targeting assembly of a particle accelerator. The side of the doors, which abut in the wall, have a staircase shape to reduce the transmission of radiation. However, additional shielding is often required in order to reduce transmission through the door clearances.

AIMS OF THE INVENTION

The present invention aims to provide a shielding comprising at least one part that can be opened and closed, which is more efficient than the prior art shieldings in preventing or limiting the entrance of radiation into the shielding and/or the exit of radiation from said shielding.

SUMMARY OF THE INVENTION

According to the present invention there is provided a shielding for reducing the amount of radiation passing through the shielding. The shielding comprises a first part and a second part, wherein the first part is arranged for being withdrawn from the second part and wherein said first and second parts comprise abutments. At least one pair of corresponding abutments of said first and second parts has a transverse section which is curvilinearly shaped along a portion of at least a part and preferably half of said transverse section.

In normal operating conditions the first and second part of the shielding are positioned in face of each other and may contact each other. When a person wants to access what is covered by the shielding, at least the first part is arranged for being withdrawn from the second part, in order to open the shielding and gaining access to what is covered by the shielding.

The term curvilinear in the present invention has the meaning of a line having in all its points a finite radius of curvature, wherein the term finite does not comprise zero. The curvilinearly shaped portion of the transverse section may extend along 50, 60, 70, 80, 90, or even 100 percent of the length of said transverse section. Preferably, the curvilinear section may have the shape of a C or an S. Other curvilinear sections may equally be employed, as long as the totality of curvilinear portions is substantially larger than the totality of rectilinear portions. More preferably, the curvilinear section may have a constant radius of curvature. Preferably, the curvilinear portions of corresponding abutments match. Preferably, at least a portion of said transverse section shows a value for the inverse of the radius of curvature different from zero.

The present invention is useful for shielding radiation produced by a radiation source, such as a particle accelerator, a target, a radioactive source or radioactive waste.

Advantageously, the radiation source is a cyclotron.

Advantageously, the shielding comprises a shell that can be filled with radiation absorbing material.

More advantageously, said shell comprises an outer region that can be filled with a high Z compound and an inner region that can be filled with a low Z compound.

Preferably, said high Z compound comprises lead or iron.

Preferably, said low Z compound comprises a polyethylene and/or a paraffin compound.

Preferably, when the invention is used for shielding radiation produced by a cyclotron comprising a target, the cyclotron comprises an additional high Z material shield in front of said target.

Advantageously, the shielding comprises wheels for displacing said first part. More advantageously, the shielding comprises wheels for also displacing said second part.

Advantageously, the shielding comprises a lifting mechanism for said wheels.

In an embodiment of the present invention, the second part is a container for limiting the exit of radiations from the radiation source to the outside. Such a container could be used, for example, for transporting and/or shielding radioactive sources, radioactive wastes, or the like.

In another, more preferred embodiment of the present invention, said first part is a lid or a door adapted for fitting in an opening of said second part. Without any limitation, said opening could refer to a ceiling wall of a chamber, or a shielding vault door.

According to a second aspect of the present invention, there is provided a method for reducing the amount of radiation passing through a shielding, the method comprising the steps of: providing a shielding comprising a first part and a second part, said first part and said second part comprising abutments and shaping corresponding abutments of the first and second part curvilinearly along a major portion of a transverse section of said abutments. The method prevents or limits the entrance of radiation into and/or the exit of radiation out of a shielding.

Preferably, the method, according to the invention, comprises the step of providing wheels for moving said first part and said second part.

Optionally, the method, according to the invention, comprises the step of providing a lifting mechanism for lifting up and down said first part and said second part such that they respectively move or rest.

Preferably, the method according to the invention comprises the step of providing a shell filled with radiation absorbing material.

More preferably, according to the second aspect of the invention, said shell comprises an outer region that can be filled with a high Z compound and an inner region that can be filled with a low Z compound.

Advantageously, according to the second aspect of the invention, said high Z compound comprises lead or iron.

Advantageously, according to the second aspect of the invention, said low Z compound comprises a polyethylene and/or a paraffin compound.

Preferably, according to the second aspect of the invention, said radiation is produced by a radiation source.

More preferably, according to the second aspect of the invention, said radiation source is a cyclotron.

Advantageously, the method according to the invention, wherein said cyclotron comprises a target, comprises the step of providing an additional high Z material shield in front of said target.

DETAILED DESCRIPTION OF THE INVENTION

Figure 1:
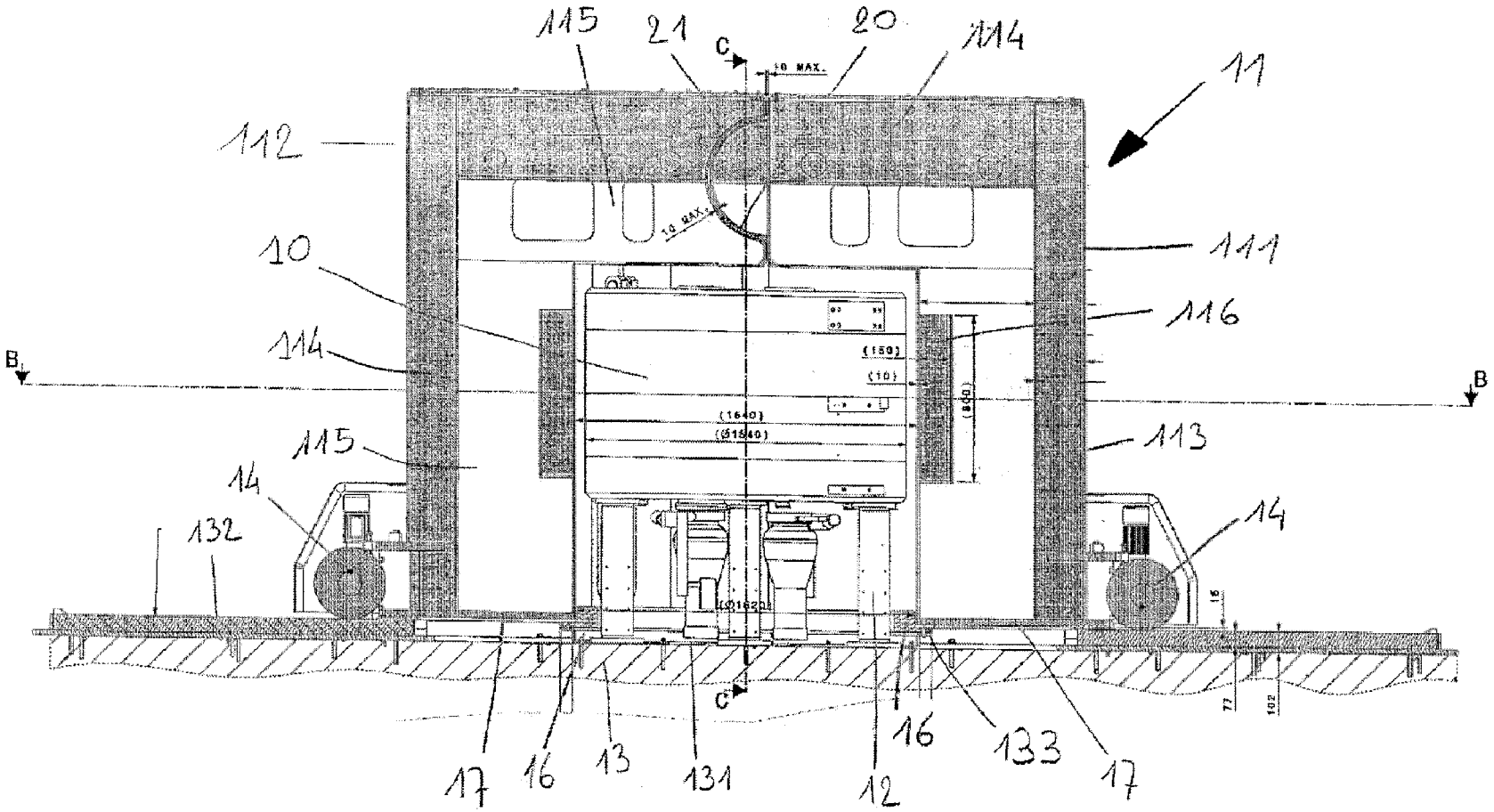
FIG. 1 represents a cyclotron encapsulated in a shielding according to the invention. A cross-sectional view of the shielding is provided in FIG. 1.
Figure 2:
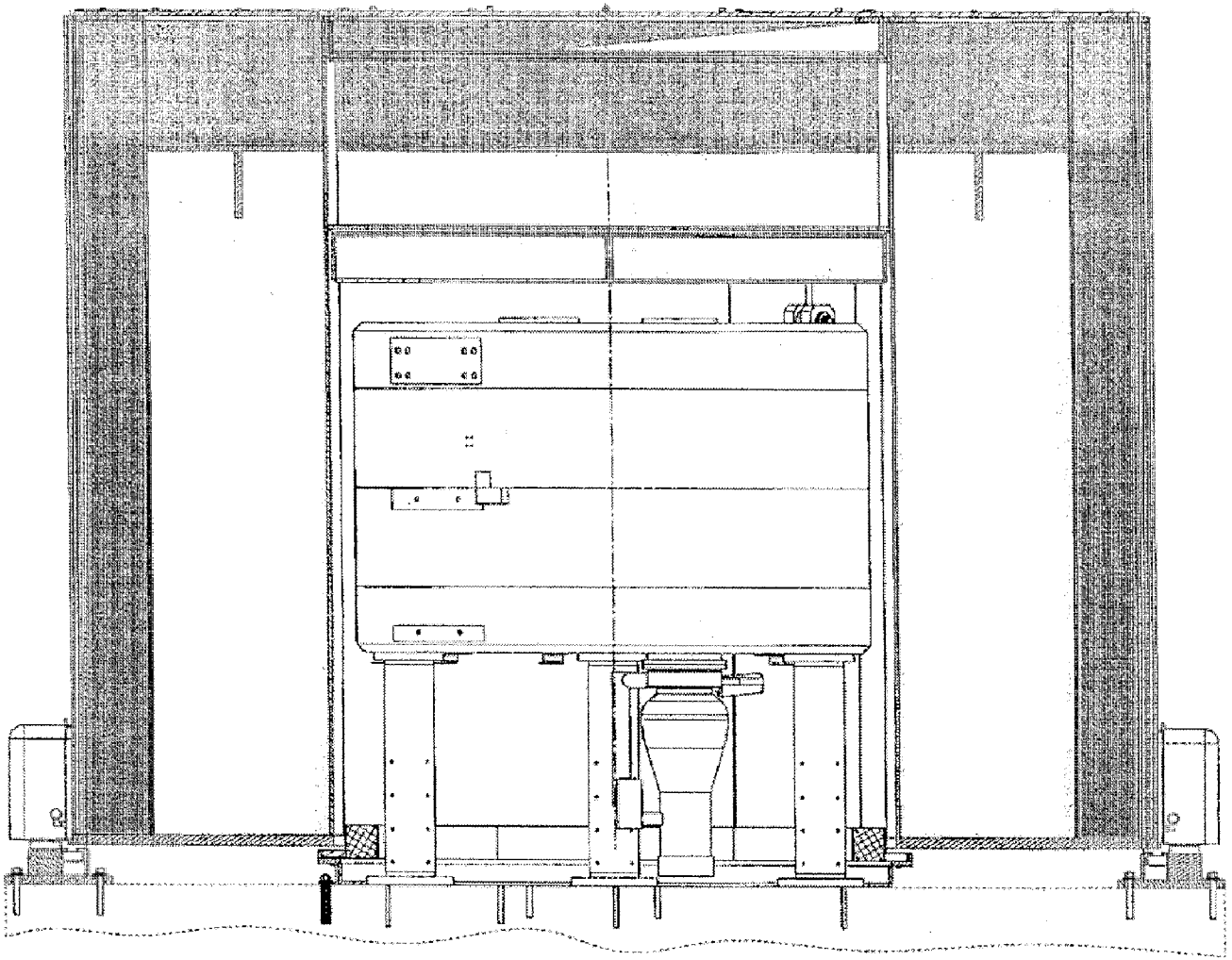
FIG. 2 represents a cross-sectional view C-C as defined in FIG. 1. The cyclotron is not sectioned.

FIG. 1 shows a radiation source 10, in the following embodied by a cyclotron, enclosed in a shielding 11. The cyclotron 10 rests on feet 12 mounted on a concrete floor 13. Pipes that lead to the cyclotron may be embedded in the floor 13. The floor level 131 on which the cyclotron is mounted is at a lower level with reference to the level 132 on which the shielding 11 rests. Shielding 11 comprises a shell 113, preferably made out of steel. This shell may be filled with radiation absorbing materials. Currently, suitable materials are e.g. lead, iron, polyethylene or a paraffin compound. Lead is provided in an outer region 114 of the shielding 11 in order to stop primary and secondary gamma rays. The inner region 115 of the shielding 11 may comprise a neutron absorbing material such as polyethylene or a paraffin compound. Preferably, an additional lead shield 116 is provided in front of each target of the cyclotron in order to slow or stop photons emitted from the source. Such an additional lead filter 116 permits to reduce the thickness of the shielding 11 at these locations for a specified required transmission dose.

Figure 4:
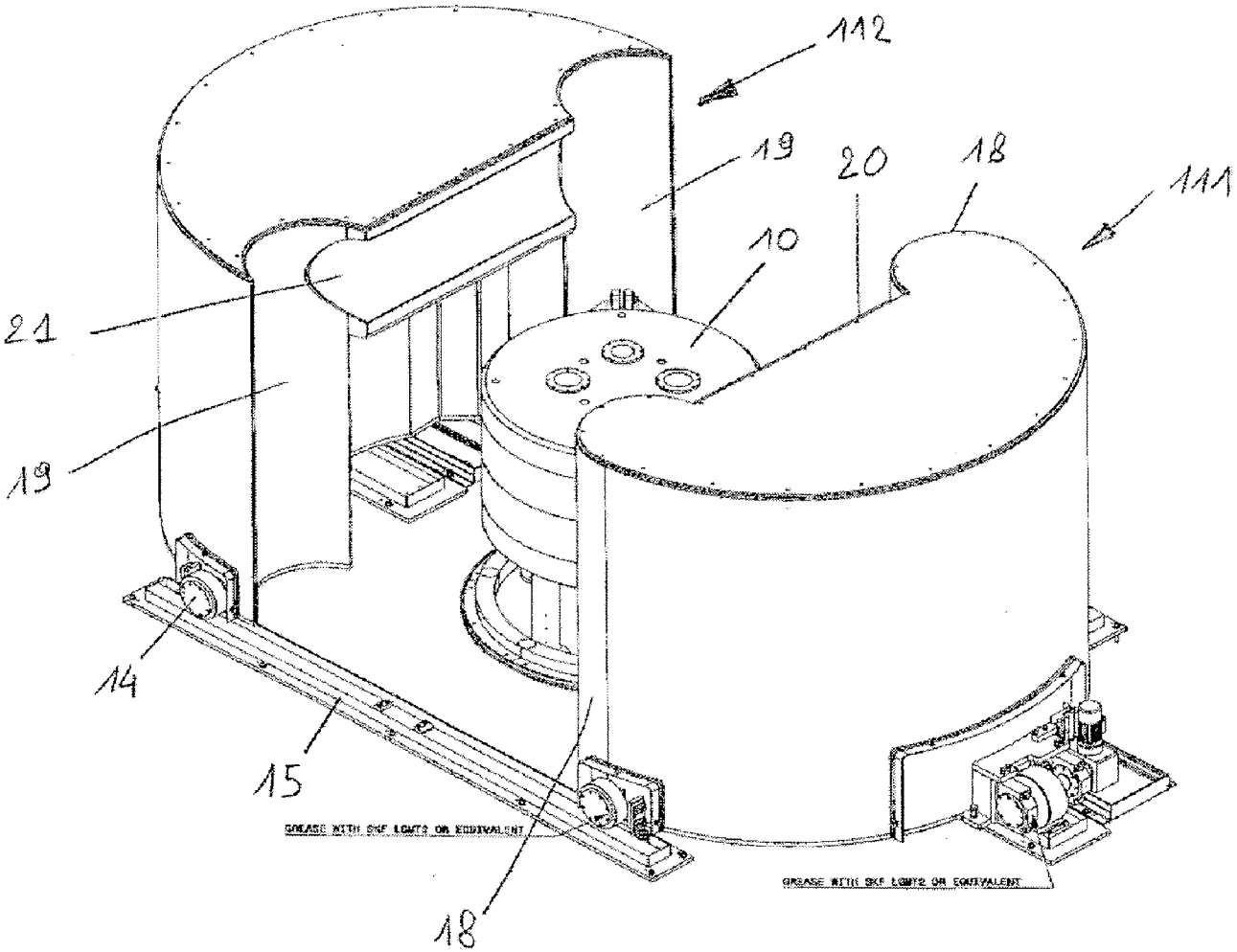
FIG. 4 represents the shielding opened.

The shielding 11 comprises two parts, a male part 111, and a female part 112, both of which are provided with wheels 14. Hence, male part 111 and female part 112 are movable in order to open and close the shielding 11. FIG. 4 shows the shielding 11 in opened state. In this state, the cyclotron can be accessed.

Figure 5:
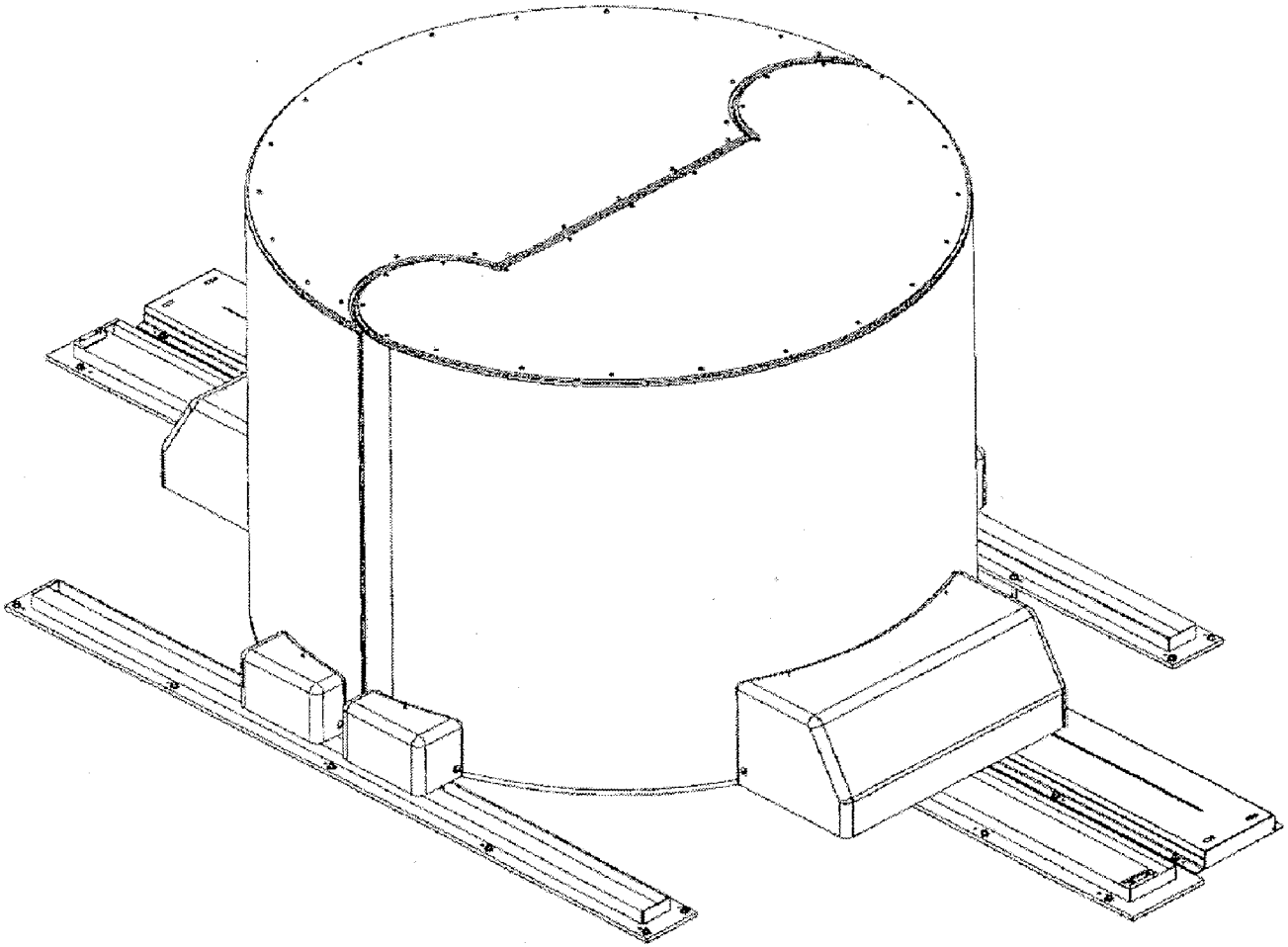
FIG. 5 represents the shielding closed.

Preferably, each of moving parts 111 and 112 rest on three wheels. As the mass of such a shielding may exceed ten tons, wheels are designed such as to be able to bear the heavy load. Wheels 14 slide on rail tracks 15. A clearance between the floor and the moving shielding parts 111 and 112 has to be provided for said parts to move. In a closed configuration, such as depicted in FIG. 5, this clearance would constitute a bottom Leakage path for the radiation emitted by the cyclotron.

A method of reducing the transmission of radiation along this leakage path comprises the step of providing a lifting mechanism for the wheels. When the moving parts 111 and 112 are to be moved, this mechanism lifts the parts up so that they may travel. When the shielding is closed, the mechanism may lift said moving parts down such that they rest on the floor without any clearance. This method is, however, cumbersome, particularly in view of the large mass of the shielding. Moreover, deformation in the structure of the shielding, due to the large mass, may cause the clearance not to vanish everywhere.

An alternative method comprises the step of placing the cyclotron on a lower floor level 131 with respect to the level 132 on which the moving parts of the shielding are placed, as shown in FIG. 1. The clearance 133 between shielding 11 and floor 13 can then be sealed by providing a strip 16 of radiation absorbing material at the inside of the shielding. In this way, radiation that enters the clearance must first pass the absorbing material before entering the clearance. Strip 16 covers the inlet of clearance 133 and may consist of polyethylene or paraffin compounds. An additional step may be to further reduce the transmission of radiation along the clearance by providing a strip 17 of absorbing material at the underside of moving parts 111 and 112.

When the shielding 11 is closed, as depicted in FIGS. 1, 2, 3 and 5, clearances occur wherever one of the moving parts 111 and 112 abuts against the other. In the particular embodiment as presently outlined and referring to FIG. 4, this occurs in between lateral abutments 18 and 19 (i.e. the points where two structures or objects meet) of respectively male part 111 and female part 112, and in between the upper abutments 20 and 21, respectively of the male and female part. In the more general case, a clearance (i.e. the amount of clear space or distance between two objects) will occur between any two moving parts and between any moving and fixed part of the shielding.

Clearances have to be kept as small as possible, but can not be avoided. They constitute a mechanical tolerance limit. In fact, the large mass of the shielding would deform the shielding structures, and a clearance has to be specified in order for one part to abut as snugly as possible against another part. However, the occurrence of these clearances notwithstanding, the transmission of radiation through such clearances can be significantly reduced by an appropriate design of the abutments 18, 19, 20 and 21 and without the need of providing additional shielding to cover the clearances.

Figure 3:
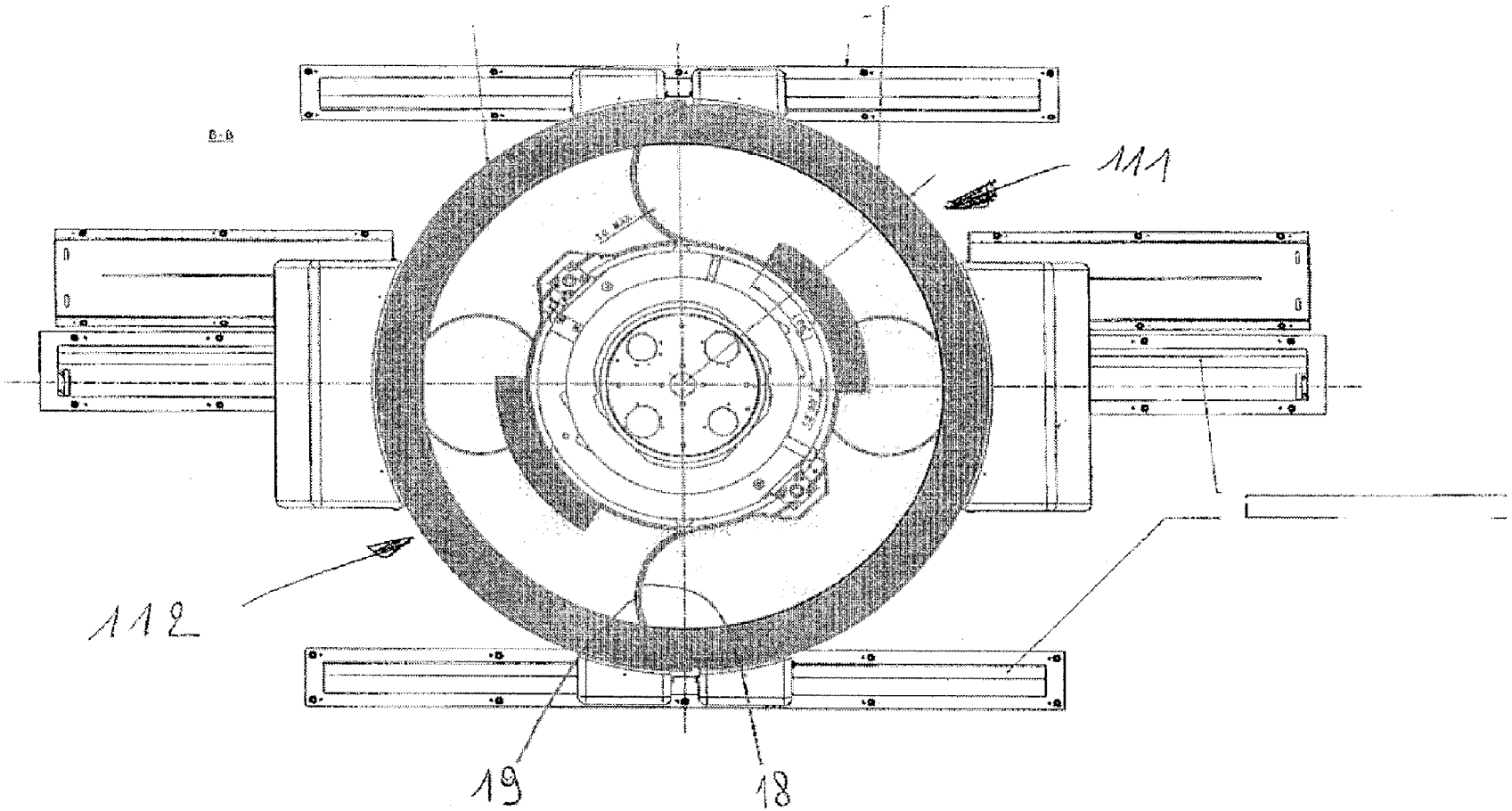
FIG. 3 represents a cross-sectional view B-B as defined in FIG. 1. The cyclotron is not sectioned.

Abutments 18 and 20 are of a male type and are arranged for fitting into the female type abutments 19 and 21. The transverse section of these abutments is curvilinearly shaped along a substantial portion of the section. Referring to FIG. 3, abutments 18 and 19 are entirely curvilinearly shaped. The transverse section of both abutments 18 and 19 has a constant radius. The radius of abutment 19 is slightly larger than the radius of abutment 18 in order to keep the design clearance constant. Referring to FIG. 1, upper abutments 20 and 21, feature a transverse section which is curvilinearly shaped along a substantial portion of the section.

Figure 10:
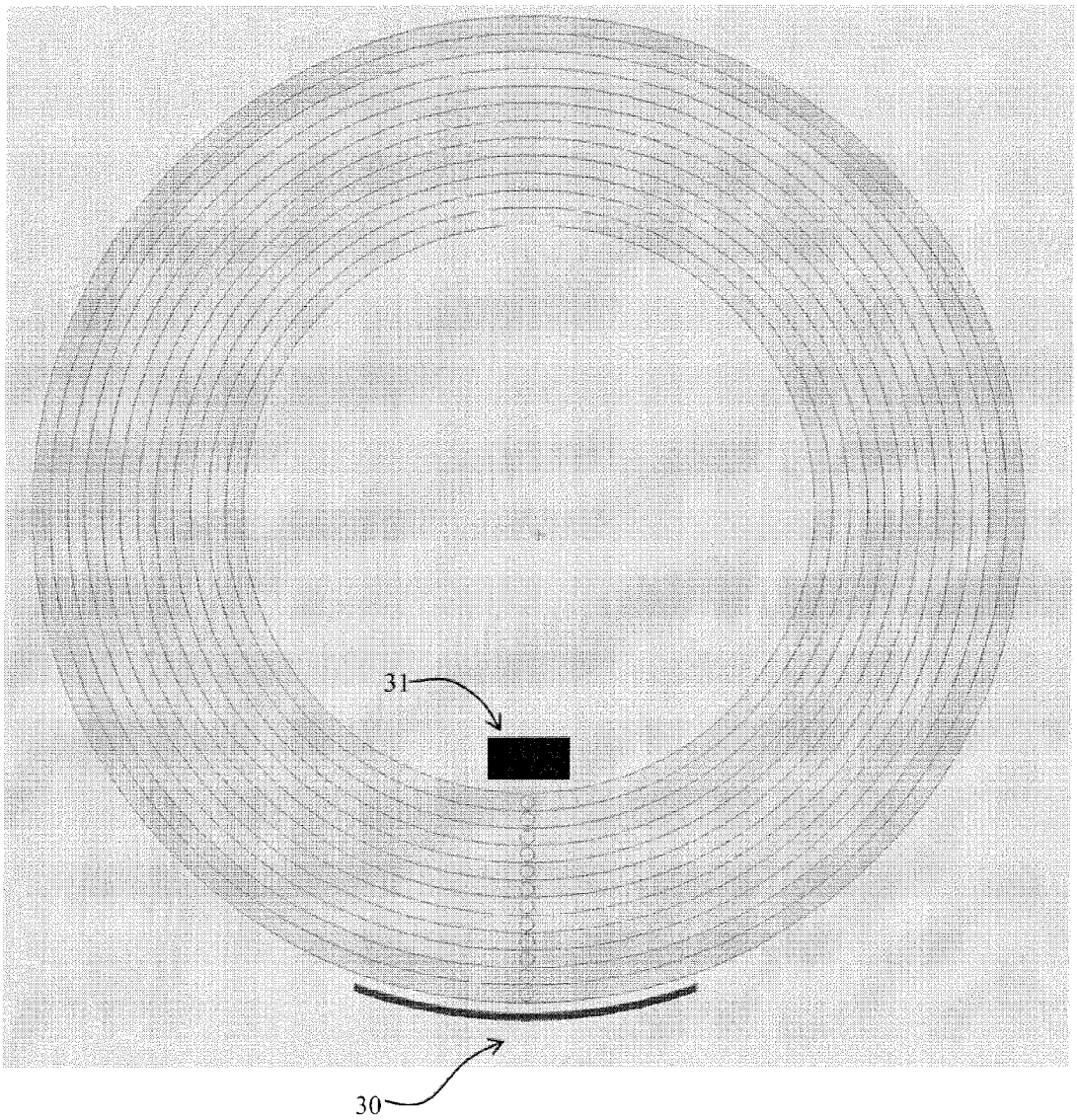
FIG. 10 represents a schematic cross-section of a shielding without any clearance used for Monte Carlo simulations.
Figure 11:
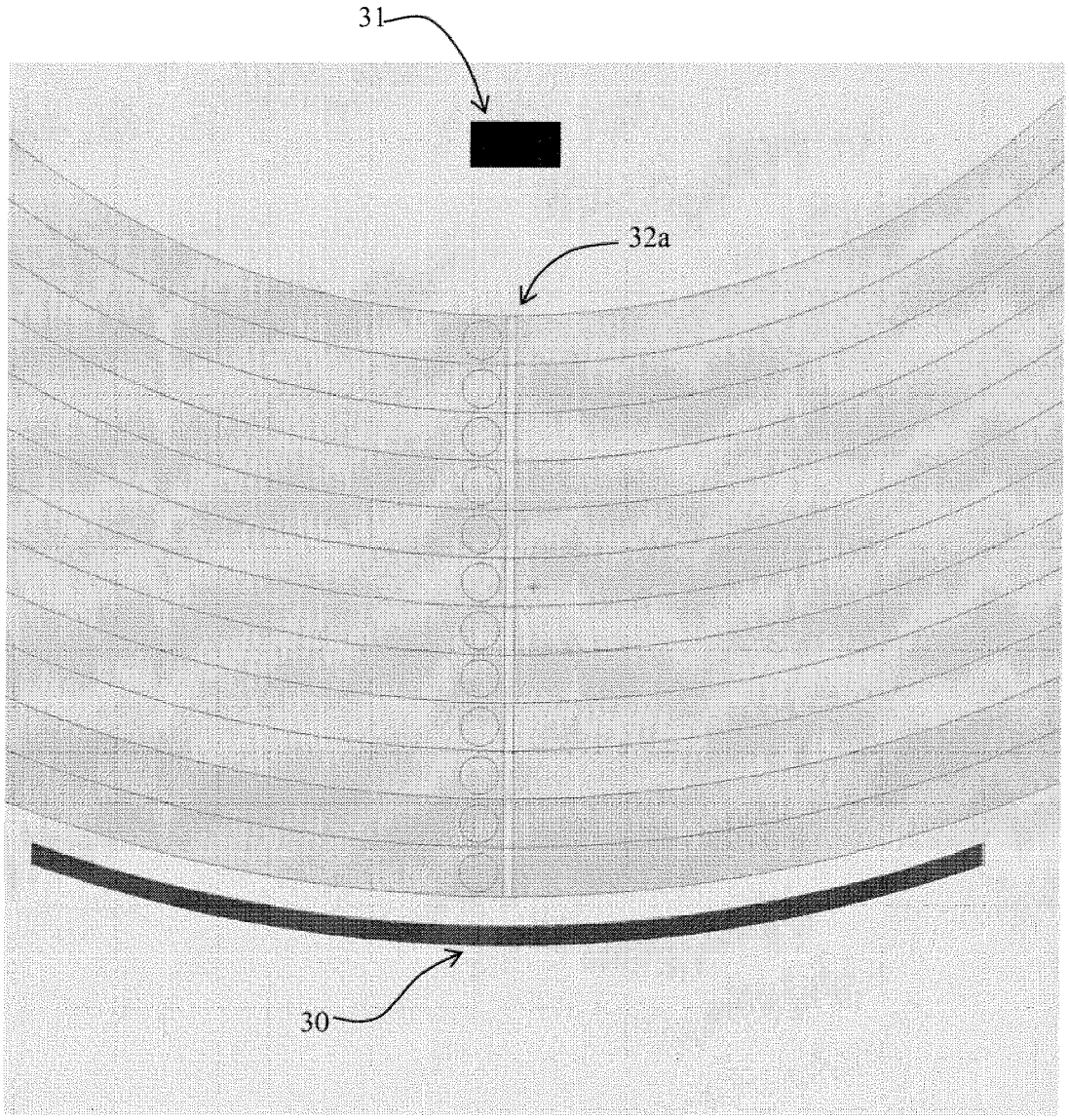
FIG. 11 represents a schematic cross-section of a shielding with a rectilinear clearance 32*a* used for Monte Carlo simulations.
Figure 12:
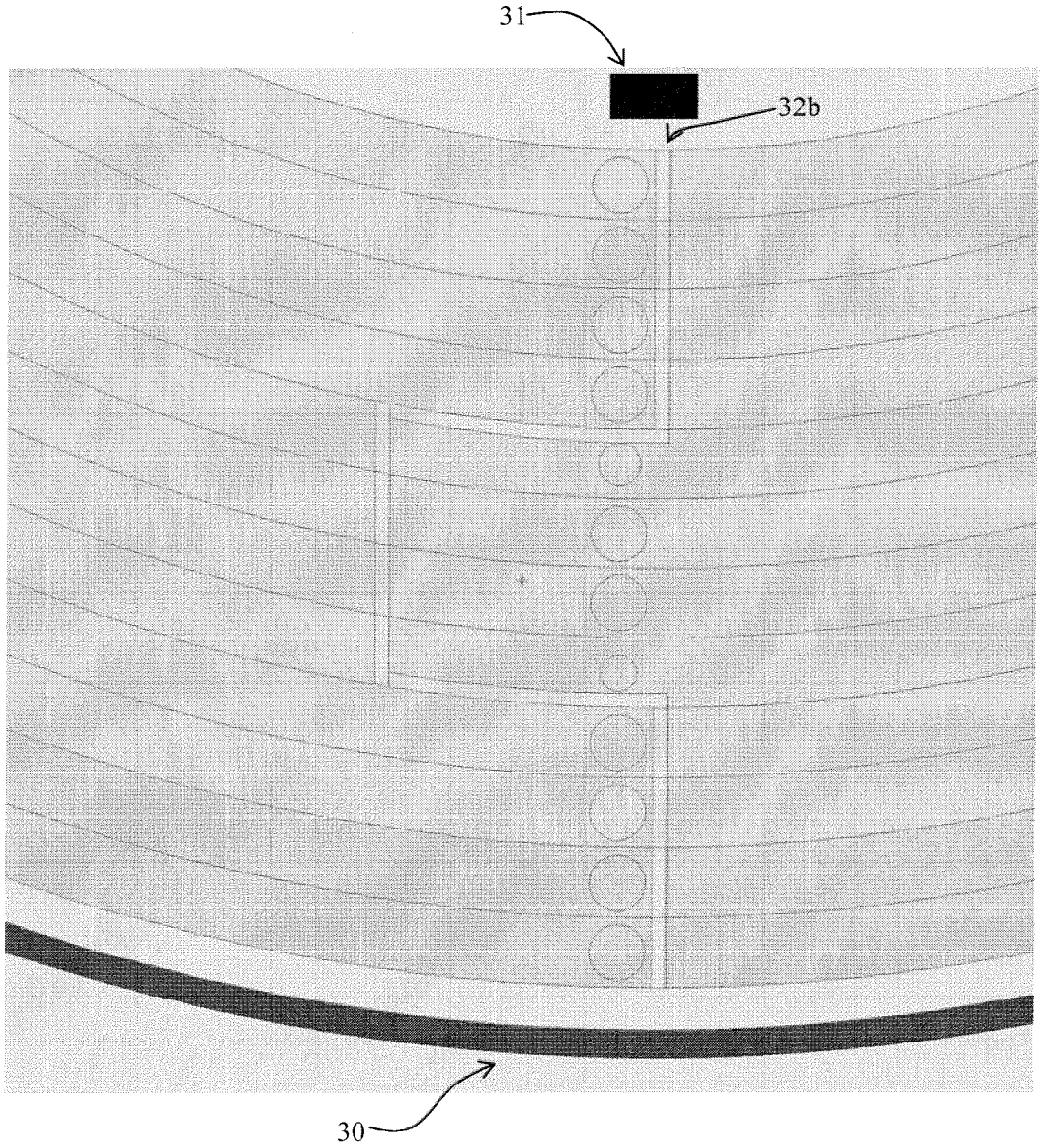
FIG. 12 represents a schematic cross-section of a shielding with a staircase rectilinear clearance 32*b* used for Monte Carlo simulations.
Figure 13:
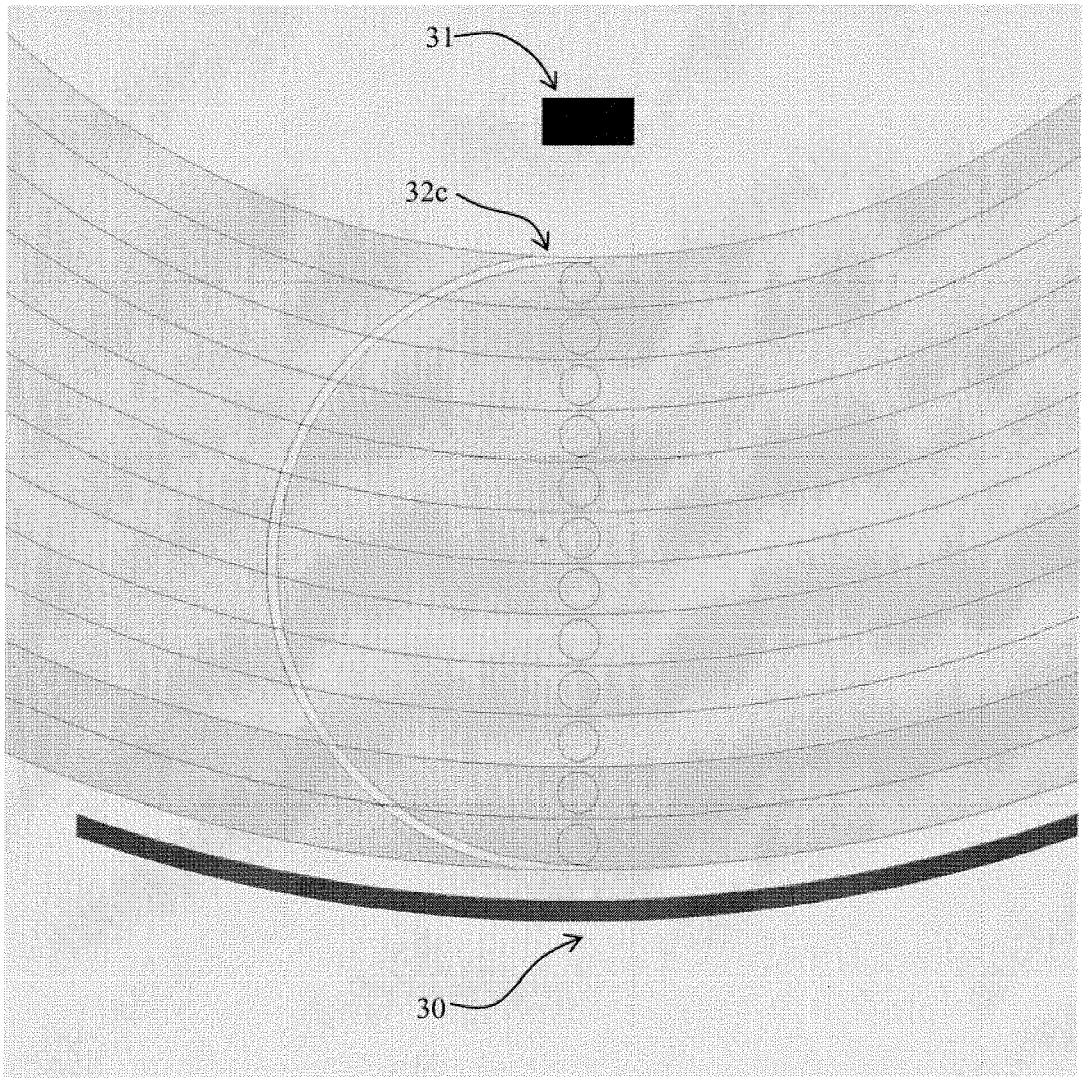
FIG. 13 represents a schematic cross-section of a shielding with a C-shaped clearance 32*c* used for Monte Carlo simulations.

FIGS. 10 to 17 present Monte Carlo simulation results of the transmission of radiation for different clearance configurations. FIG. 10 represents the case of a totally closed shielding, with no clearances. FIG. 11 represents the case of a shielding with one rectilinear clearance 32*a*. FIG. 12 represents the case of a shielding with a stair-cased clearance 32*b*. FIG. 13 represents the case of a shielding with a C-shaped clearance 32*c*. At a number of regularly spaced locations, within the shielding and along the outside of the shielding, the incident radiation, emitted from the target 31, was measured by a virtual dosimeter in terms of neutron and photon doses. These locations are indicated by hollow circles on FIGS. 10-13.

Figure 6:
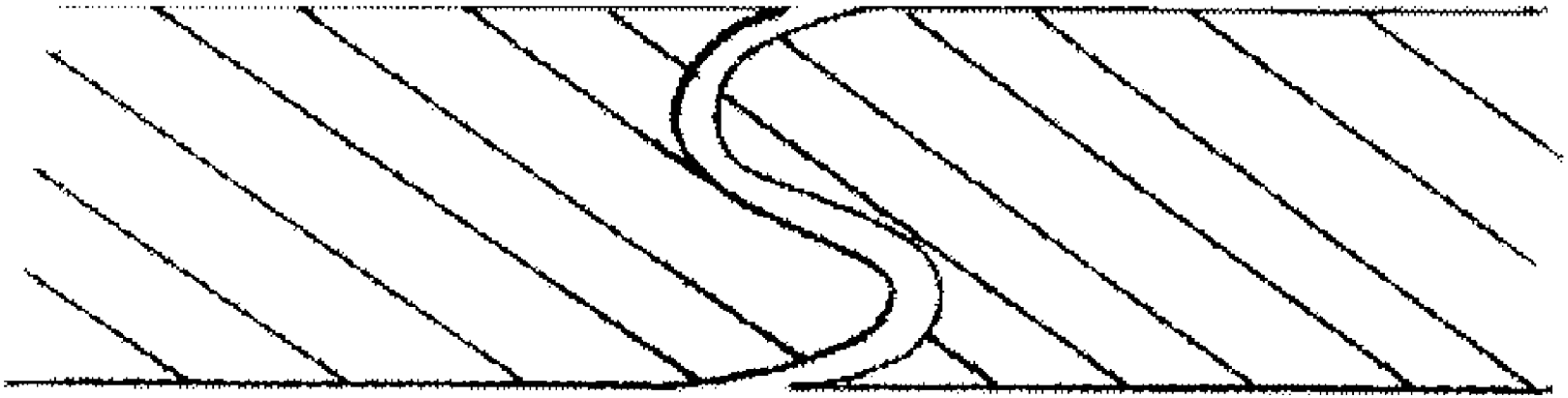
FIG. 6 represents an S-shaped clearance.
Figure 7:
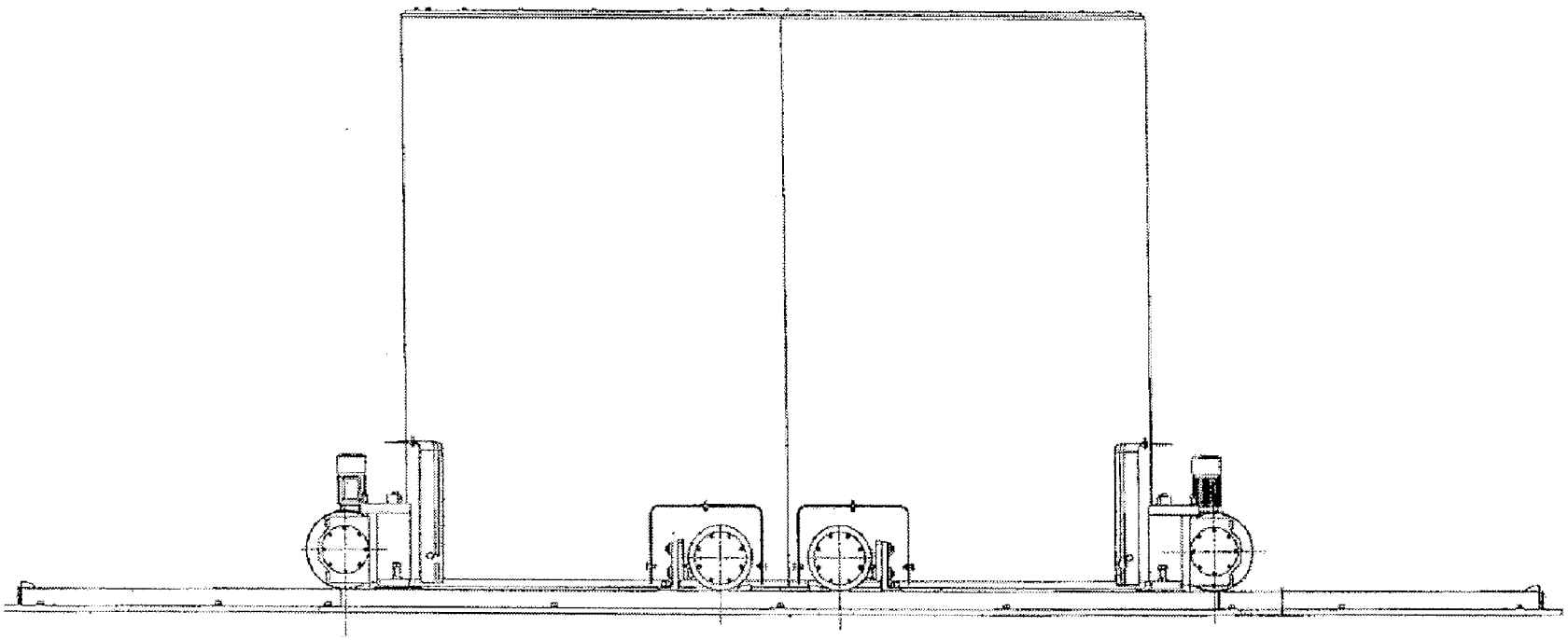
FIG. 7 represents a lateral view of the shielding in closed state.
Figure 8:
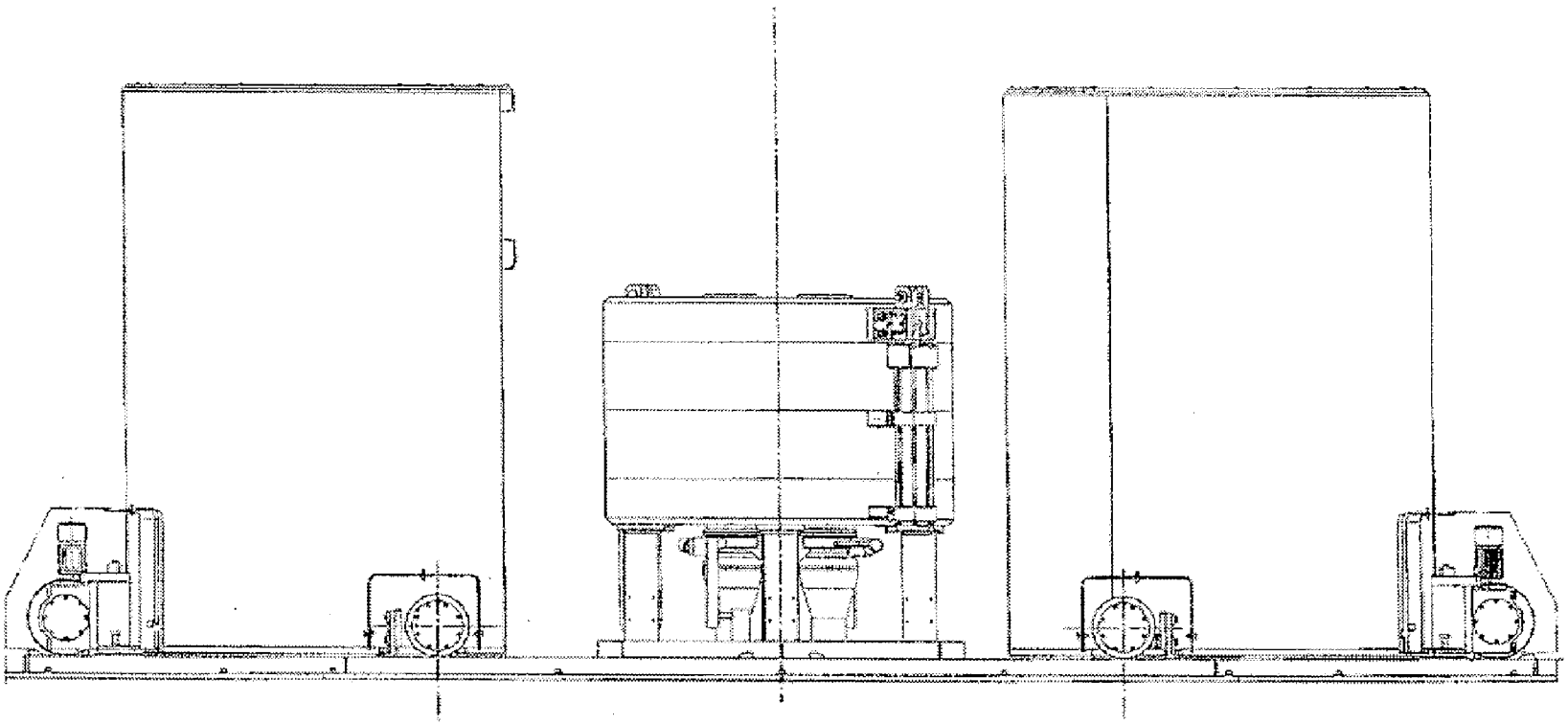
FIG. 8 represents a lateral view of the shielding in opened state.
Figure 9:
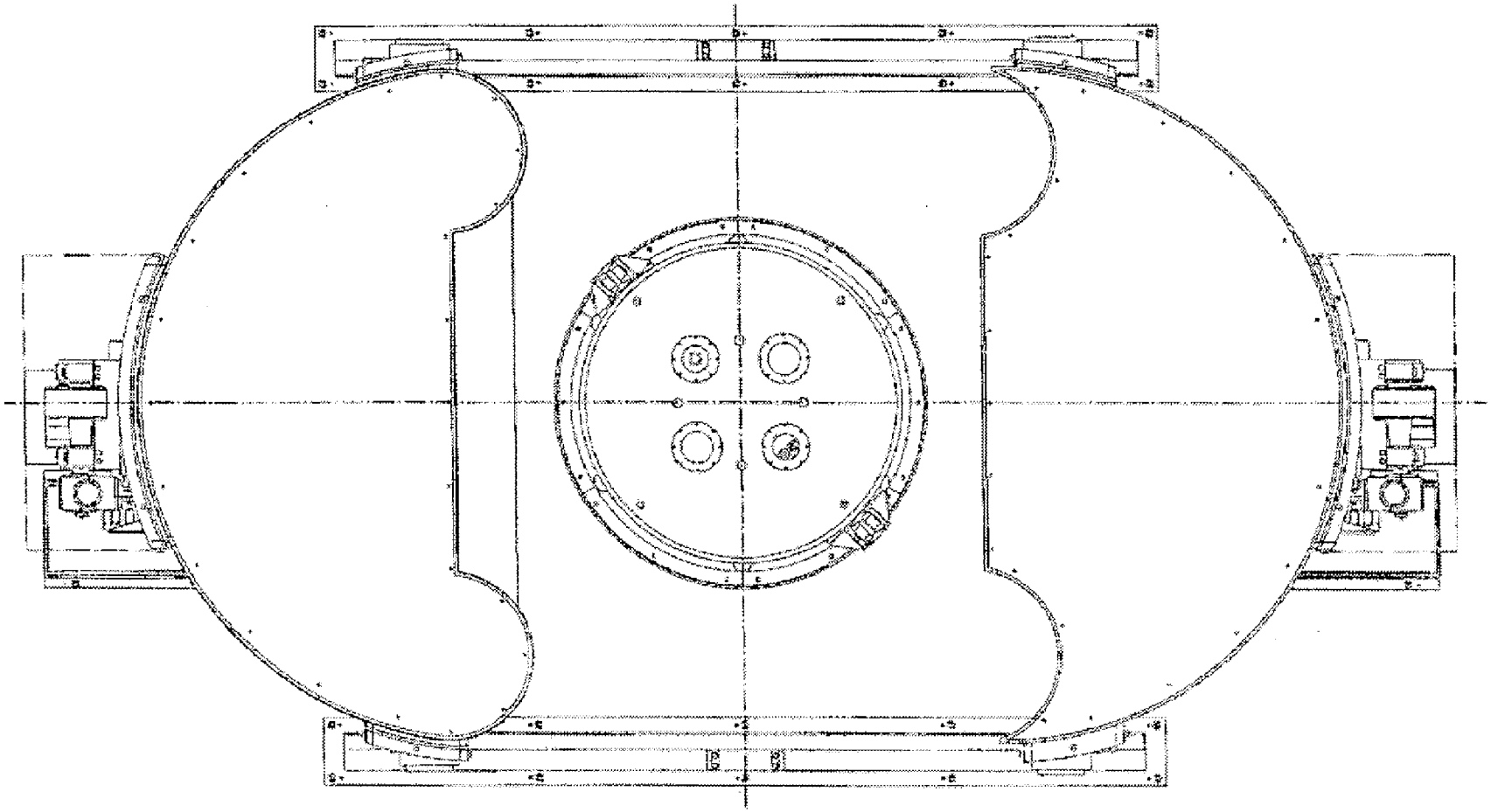
FIG. 9 represents a top view of the shielding in opened state.

The fact that the clearance follows a curvilinear path along a substantial portion of its length, causes the radiation (photons, neutrons, . . . ) travelling through the clearance to be reflected a much larger number of times with reference to a clearance having large rectilinear portions. As only a fraction of the incident radiation is reflected, the former kind of clearances provides a reduced transmission of radiation. FIGS. 1 to 5 present abutments featuring an essentially C-shaped transverse section. Other curvilinear sections are equally effective, as long as the totality of curvilinear portions is substantially larger than the totality of the rectilinear ones. FIG. 6 depicts, for example, an S-shaped clearance.

Furthermore, referring to FIG. 13, one can observe that the total thickness of the shielding that radiations encounter, when travelling through the shielding, is approximately the thickness of the shielding minus two times the thickness of the gap in the clearance 32*c*, independently from the direction of the radiations emitted from the target 31. By contrast, referring to FIG. 11 or 12, one can observe that said total thickness value depends somehow on the direction of the radiations. In the latter case, one can also easily realize that some directions are privileged since they make the total thickness value met by radiations much lower than the one according to the case of FIG. 13.

Figure 14:
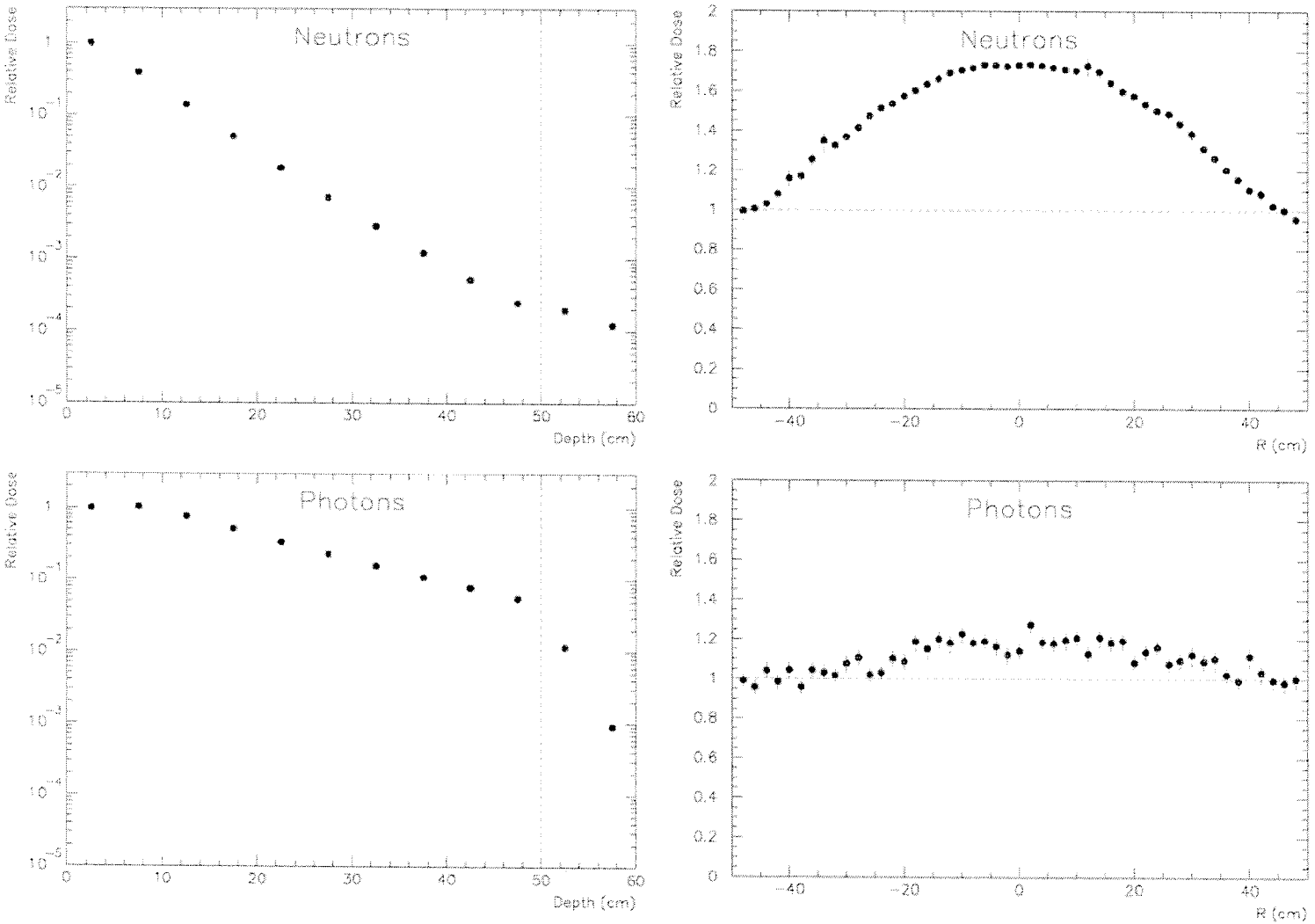
FIG. 14 represents Monte Carlo simulated transmission doses for the configuration of FIG. 10.
Figure 15:
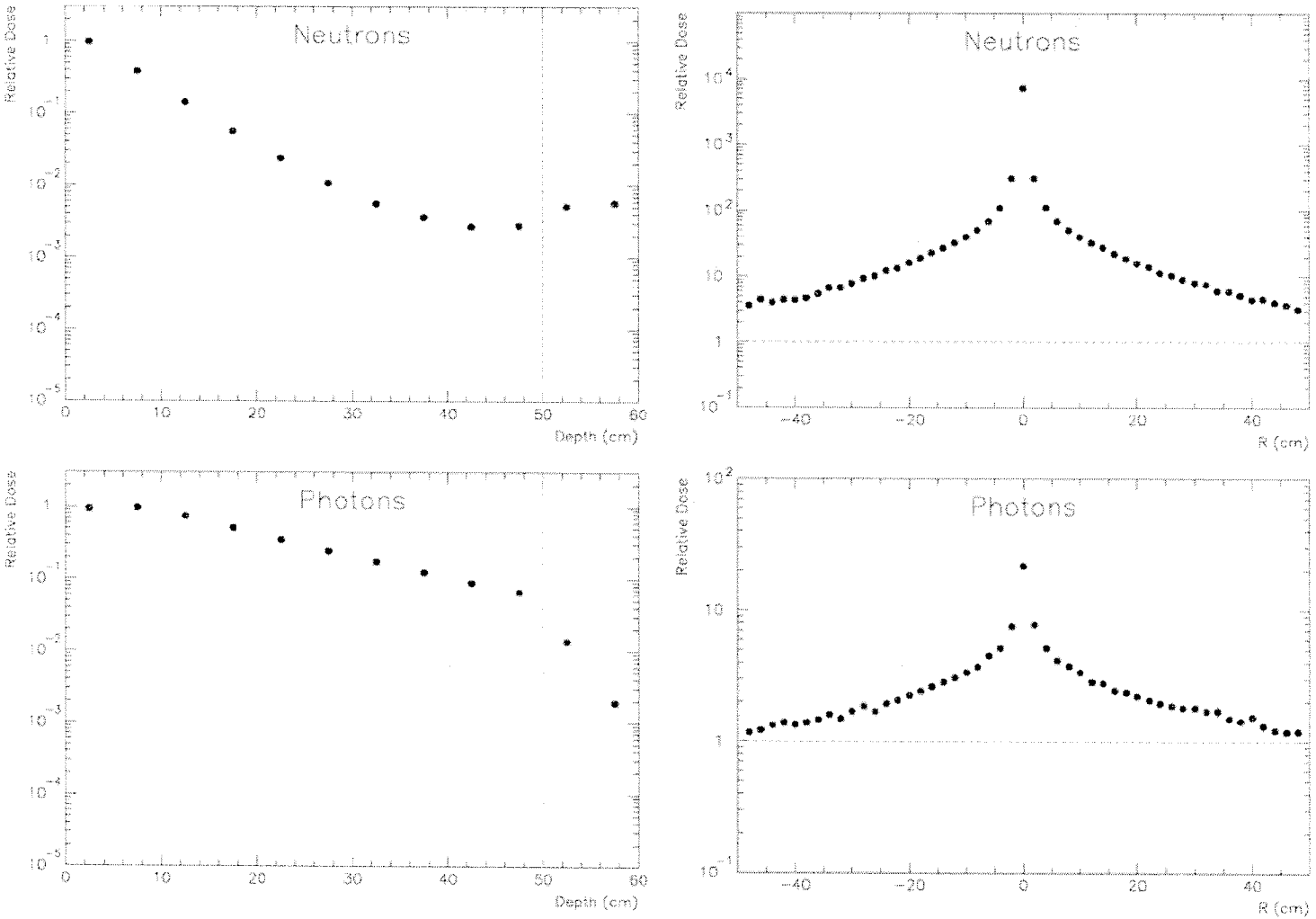
FIG. 15 represents Monte Carlo simulated transmission doses for the configuration of FIG. 11.
Figure 16:
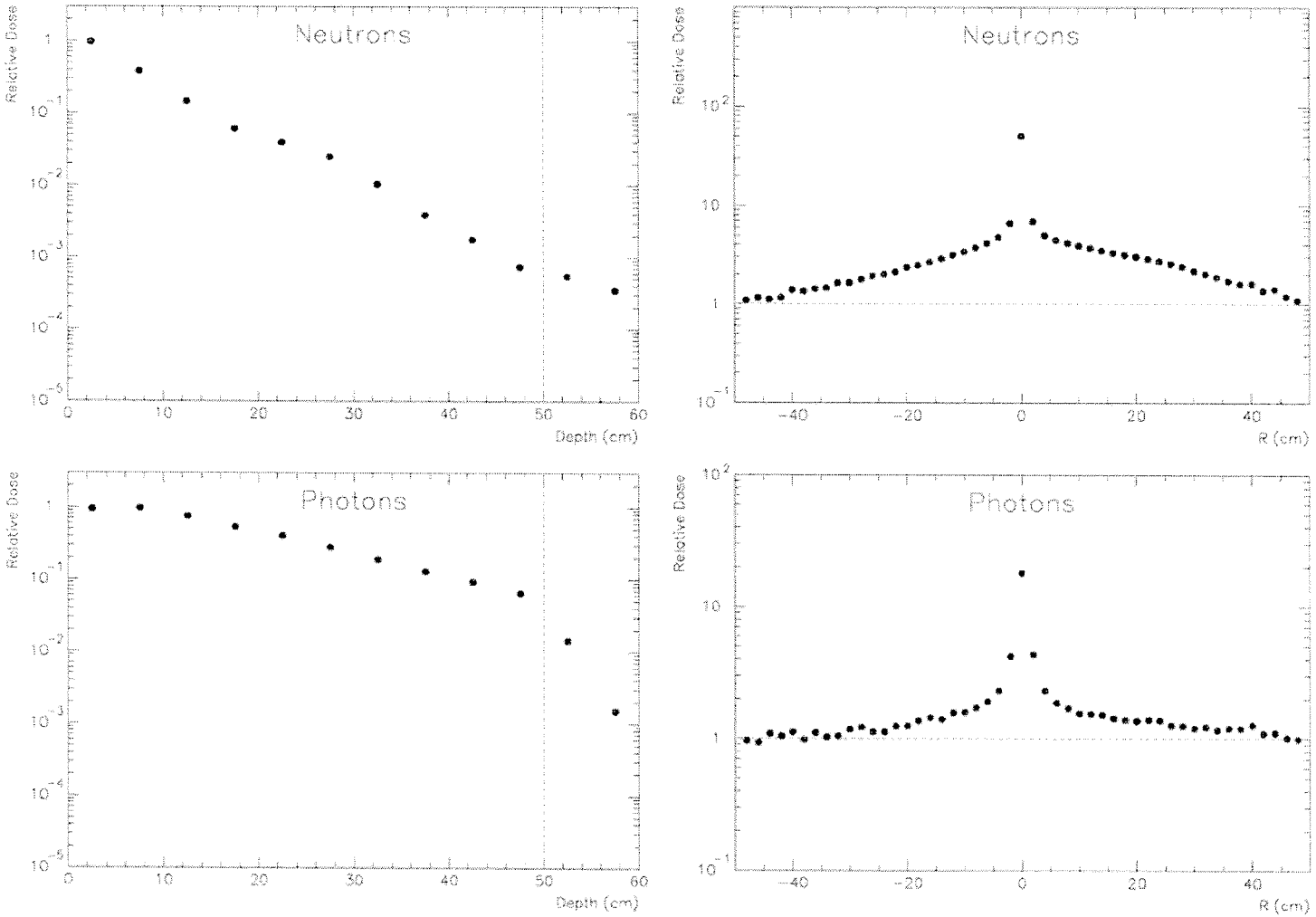
FIG. 16 represents Monte Carlo simulated transmission doses for the configuration of FIG. 12.
Figure 17:
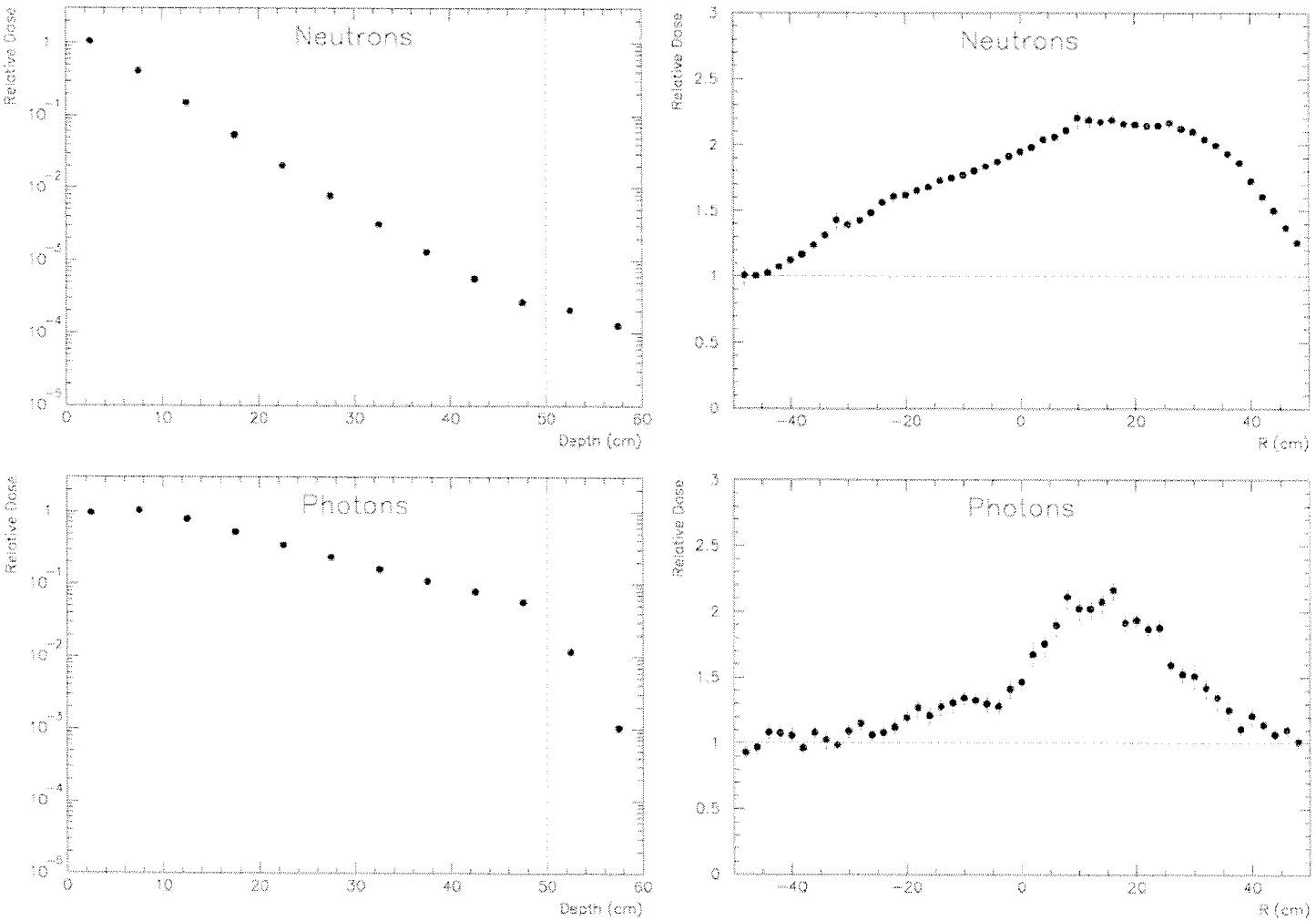
FIG. 17 represents Monte Carlo simulated transmission doses for the configuration of FIG. 13.

The results of these Monte Carlo simulations for the cases depicted in FIGS. 10-13 are presented in FIGS. 14-17. FIG. 14 presents the simulated incident doses for the case of FIG. 10. The graphs on the left hand show the doses along the rectilinear path in the shielding. On the horizontal axis, 0 cm refers to the inner border of the shielding, and 60 cm to the outer border. The dashed vertical line marks the limit between the polyethylene or paraffin compound and the lead or iron. The doses are normalised with reference to the first calculated value. The graphs on the right hand show the doses along an arc (virtual dosimeter) 30, outside the shielding. On the horizontal axis, 0 cm refers to the centre of the arc. The doses are normalised with reference to the first calculated value (leftmost value on the graphs). Likewise, FIGS. 15-17 present simulation results for the cases depicted respectively in FIGS. 11-13. For the case of the rectilinear clearance of FIG. 11, a very large dose is transmitted through the clearance 32*a*, as shown in FIG. 15. For the case of the stair-cased clearance of FIG. 12, at the arc centre a peak value in relative dose is 50 for neutrons and 20 for photons, as shown in FIG. 16. These peak values are significantly reduced by the use of the C-shaped clearance of FIG. 13, as shown in FIG. 17. These peak values reduce to 2.3 and 2.2 respectively. The location of occurrence of the peaks is also displaced along the arc (not in the centre any more). Comparing the results of FIG. 17 with the results of FIG. 14 it is clear that the values with the C-shaped clearance are of the same order of magnitude as the values for the case of a totally closed shielding. Additional shielding is therefore not necessary.

In a preferred embodiment according to the present invention, the shielding 11 comprises a steel shell 113. The total thickness of the shielding is 850 mm around the cyclotron and 600 mm above it. The outer diameter of the shielding is 3.3 m. The gap between cyclotron and shielding in closed state is about 5 cm. Abutments in this preferred embodiment have a transverse section essentially of C or S shape, and abut against each other, each of said abutments having a complementary shape with respect to another.

Figure 18A:
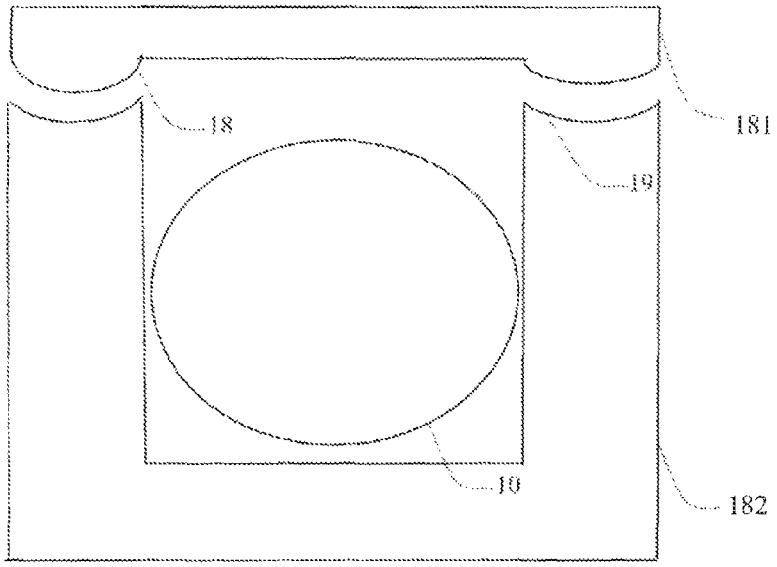
FIG. 18*a* represents a preferred embodiment according to the invention.

In another preferred embodiment according to the present invention, a part 182, as shown in FIG. 18*a*, is a container. When the part 181 and the part 182 are in a closed configuration, the C-shape of the abutments 18 and 19 limits the exit of radiations from the radiation source 10 to the outside. Such a container could be used, for example, for transporting and/or shielding a radioactive source, radioactive wastes, or the like.

Figure 18B:
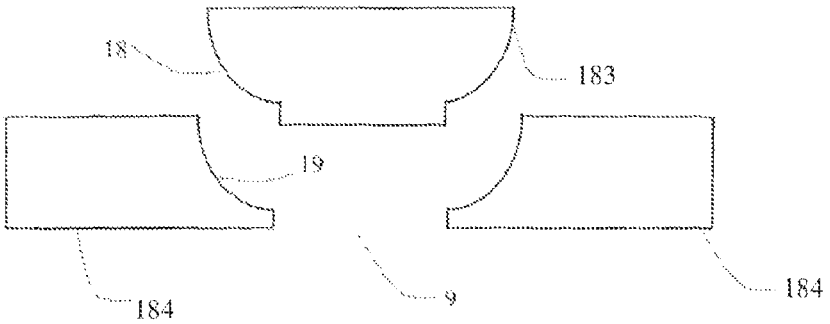
FIG. 18*b* represents another preferred embodiment according to the invention.

In another preferred embodiment according to the present invention, represented in FIG. 18*b*, a part 184, having C-shaped abutments 19, has an opening 9 which can be closed with the moveable part 183, also having C-shaped abutments 18. Without any limitation, the part 184 can be a ceiling wall of a chamber, or simply a shielding vault door.

The invention claimed is:

1. A shielding for reducing the amount of radiation passing through the shielding, the shielding comprising a first part and a second part, the first part configured to be withdrawn from the second part and said first and second parts comprising abutments which face each other, at least one pair of facing abutments of said first and second parts has a transverse section, the section comprising a curvilinearly shaped portion which nests into an opposite curvilinear portion.

2. The shielding according to claim 1, wherein said portion extends along at least 60% of said section.

3. The shielding according to claim 1 or 2, wherein the radius of curvature of the curvilinear shape of said portion is constant.

4. The shielding according to claim 1, wherein at least said portion shows a value of the radius of curvature different from zero.

5. The shielding according to claim 1, comprising a shell that can be filled with radiation absorbing material.

6. The shielding according to claim 5, wherein said shell comprises an outer region that can be filled with a high Z compound and an inner region that can be filled with a low Z compound.

7. The shielding according to claim 6, wherein said high Z compound comprises lead or iron.

8. The shielding according to claim 6, wherein said low Z compound comprises a polyethylene or paraffin compound.

9. The shielding according to claim 1, the shielding configured to shield radiation produced by a radiation source and wherein said shielding is provided at an outer side of said source.

10. The shielding according to claim 9, wherein said radiation source is a cyclotron.

11. The shielding according to claim 10, wherein said cyclotron comprises a target and an additional high Z material shield in front of said target.

12. The shielding according to claim 1, further comprising wheels configured to displace said first part and/or said second part.

13. The shielding according to claim 12, further comprising a lifting mechanism for said wheels.

14. The shielding according to claim 12, wherein said first part is a lid or a door configured to fit in an opening of said second part.

15. The shielding according to claim 1, wherein said second part is a container configured to limit the exit of radiation from a radiation source in the container.

16. The shielding according to claim 1, wherein said curvilinear portion extends along at least 70% of said section.

17. A method for reducing the amount of radiation passing through a shielding, the method comprising the steps of:

providing a shielding comprising a first part and a second part, said first part and said second part comprising abutments and shaping corresponding abutments of the first and second parts curvilinearly along a major portion of a transverse section of said abutments.

* * * * *